US006049726A

United States Patent [19]

Gruenwald et al.

[11] Patent Number: 6,049,726

[45] Date of Patent: Apr. 11, 2000

[54] PLANAR FILTER WITH FERROELECTRIC AND/OR ANTIFERROELECTRIC ELEMENTS

[75] Inventors: Werner Gruenwald, Gerlingen; Christian Neumann, Moeglingen; Matthias Klauda, Stuttgart, all of Germany

[73] Assignee: Robert Bosch GmbH, Stuttgart, Germany

[21] Appl. No.: 08/861,201

[22] Filed: May 21, 1997

[30] Foreign Application Priority Data

May 24, 1996 [DE] Germany ..... 196 20 932

[51] Int. Cl.[7] ..... H01P 1/203; H01B 12/02

[52] U.S. Cl. ..... 505/210; 333/99 S; 333/205

[58] Field of Search ..... 333/99 S, 205, 333/235; 505/210, 700, 701, 866

[56] References Cited

U.S. PATENT DOCUMENTS 5,472,935 12/1995 Yandrofski et al. ..... 505/701 X 5,617,104 4/1997 Das ..... 333/99 S X 5,694,134 12/1997 Barnes ..... 333/161 X 5,965,494 10/1999 Terashima et al. ..... 333/99 S X

FOREIGN PATENT DOCUMENTS

WO94/28592 12/1994 WIPO .

*Primary Examiner*—Benny T. Lee

*Attorney, Agent, or Firm*—Michael J. STriker

[57] ABSTRACT

An electrically tunable planar filter has a filter element including a substrate having an upper side and a wave-guide arranged on the upper side of the substrate, at least one tuning element composed of at least one material selected from the group consisting of a ferroelectric material and an antiferroelectric material with adjustable voltage applied to the tuning element and thereby with an adjustable dielectric constant, the tuning element being arranged at the upper side of the substrate.

9 Claims, 3 Drawing Sheets

PLANAR FILTER WITH FERROELECTRIC AND/OR ANTIFERROELECTRIC ELEMENTS

BACKGROUND OF THE INVENTION

The present invention relates to a planar filter with ferroelectric and/or antiferroelectric elements.

Such a planar filter with ferroelectric and/or antiferroelectric elements is disclosed for example in the patent document WO 94/28592. In this filter a ferroelectric or antiferroelectric layer is mounted on a dielectric substrate. The microstructured high temperature super-conductive layer is arranged on the layer substrate and in particular on its upper side, while an unstructured high temperature super conductive layer is also arranged on the lower side. Together they form a band pass filter in the microstrip conductor form. A planar electrode is located several millimeters above the upper superconductive structure. By applying a voltage between the upper high temperature superconductive layer and the planar electrode, the effective dielectric constant of the intermediate space between the structure superconductive layer and the unstructured super-conductive layer can be changed since the dielectric constant of the ferroelectric or the antiferroelectric substantially varies in dependence on the applied voltage. Thereby the filter characteristic also changes, in particular its transmission frequency.

SUMMARY OF THE INVENTION

Accordingly, it is an object of present invention to provide a filter of the above mentioned general type, which has particularly low losses.

In keeping with these objects and with others which will become apparent hereinafter, one feature of present invention resides, briefly stated, in a planar filter of the above mentioned type, which has a wave guide arranged on an upper side of a substrate, and at least one tuning element composed of ferroelectric and/or antiferroelectric material with which a voltage applied to the ferroelectric or antiferroelectric element and thereby the dielectric constant can be adjusted, wherein the tuning element is arranged at an upper side of a substrate.

By the arrangement of the ferroelectric or antiferroelectric tuning element above the superconductive microstructure, a substrate with optimal dielectric properties can be selected between both superconductive layers. Moreover, it is especially advantageous that with the selection of the substrate the requirements of the epitactic growth of the superconductive layers on the dielectric substrate can be particularly taken into account. As a result, with better producable superconductive layers, high grade filters are realized.

In accordance with another feature of present invention it is especially advantageous when the filter element and the tuning element are separate components. Thereby coarse tuning can be performed by selection of a corresponding ferroelectric or antiferroelectric tuning, while fine tuning can be performed electrically on the assembled components.

Moreover, it is advantageous when the conductor layers are produced from superconductive cuprates. Thereby the cooling of the filter can be performed less expensively than with the use of conventional superconductors.

Furthermore, it is especially advantageous when the ferroelectric or antiferroelectric element is produced from a layer applied on the housing cover. Thereby a very simple mechanical mounting and low expense during adjustment are provided.

It is also especially advantageous when the ferroelectric or antiferroelectric element is produced from a layer which is mounted on the planar filter substrate with insulating spacers. Thereby the filter remains adjustable also with removed cover.

It is also advantageous when the ferroelectric or antiferroelectric layer is subdivided by microstructuring methods into individual segments. Thereby the dielectric constants of each individual element can be regulated separately, since therefore a band path filter element is produced with upper and lower edges and its fine structure is finally adjustable separately within the transmission band.

Further, it is especially advantageous to use several massive ferroelectric or antiferroelectric bodies as the tuning elements. Thereby the tuning region for each individual resonator element of the planar filter is expanded.

Finally, it is especially advantageous when the individual ferroelectric or antiferroelectric tuning elements are provided with a displacing device. Thereby a wider regulating and compensating region can be obtained.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
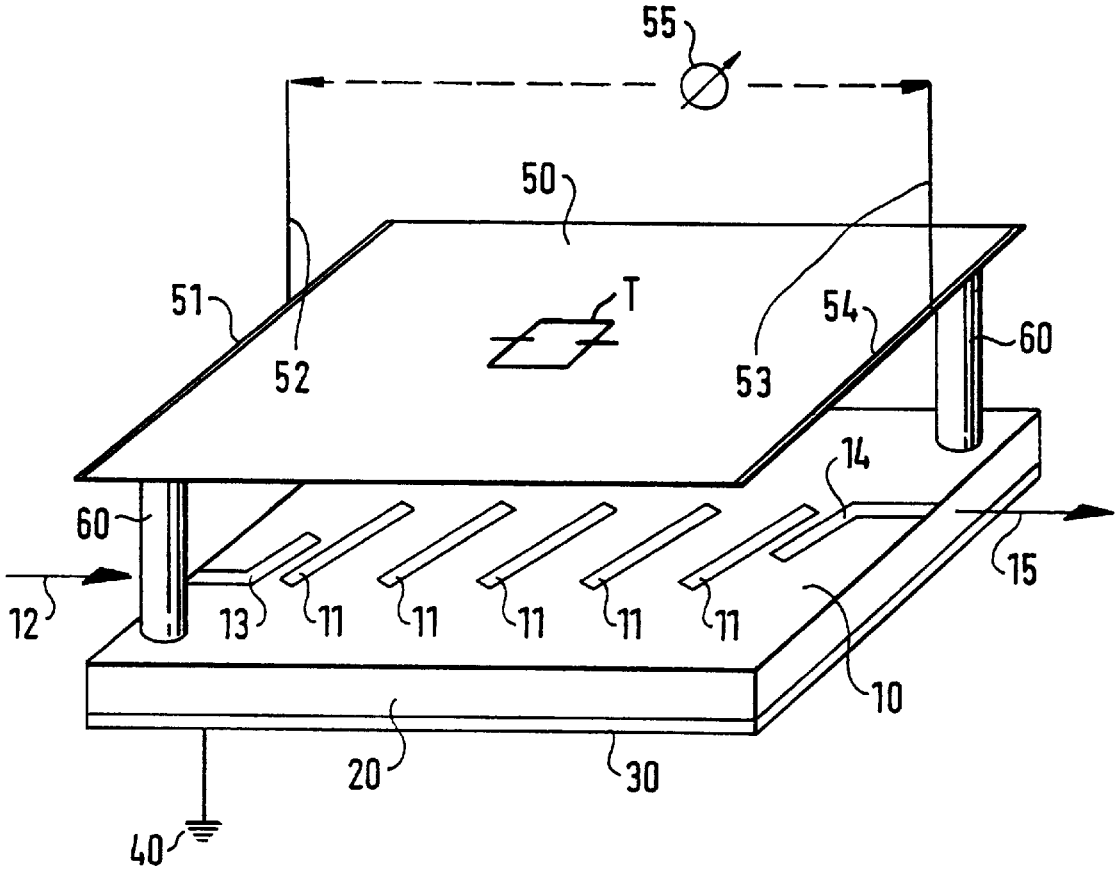
FIG. 1 is a view showing a planar filter in accordance with the present invention with microstrip conductor structure and with a planar ferroelectric tuning element arranged above it.

FIG. 1 shows a planar band path filter on the basis of high temperature super-conductors mounted on a dielectric substrate 20. For better visibility, an eventually available housing is not shown. The high temperature super-conductor layer on a lower side 30 remains unstructured (without waveguiding structure) and operates as a ground conductor 40. Resonators structures 11 as well as a capacitively coupled input 13 and a capacitively coupled output 14 are formed from the high temperature super conductor layer on the upper side by means of microstructuring methods. A ferroelectric tuning element 50 with two electrodes 51 and 54 and associated conductors 52 and 53 is located above a wave-guide structure 10. This ferroelectric tuning element 50 is mounted over the wave-guide structure 10 in a corresponding distance by spacers 60 which are electrically insulating and in some cases thermally insulating. Alternatively, the ferroelectric tuning element 50 with its electrodes 51 and 54 and the conductors 52 and 53 can be also mounted on the layer structure on the housing cover or a housing side wall. The ferromagnetic tuning element 50 is provided with means T for changing its temperature.

In the further text the wave-guide structure 10 identifies the unit composed of resonator structures 11, input 13 and output 14, the filter element identifies a unit which includes the wave-guide structure 10, a conductor 30 and the substrate 20. The filter is a combination of the filter element and the tuning element.

An incoming microwave signal or millimeter wave signal 12 is reflected by the resonator structures 11. If its frequency does not coincide with the resonance frequency of the resonance structure. Otherwise it is transmitted, and the greater part of the wave radiation comes before in the dielectric substrate 20. Since the dielectric substrate 20 is optimized for low losses, which means small imaginary part of the dielectric constants as well as good growth conditions for the superconductive layer, the damping of the transmitted signal is very low. The filtered signal 15 is available at capacitively coupling output 14. The five resonators in this embodiment have small difference in position and width of the own resonance. The super position of the individual resonances provide the transmission band.

The frequency position of the individual resonances as well as their coupling under one another are determined by the effective dielectric function of the medium which surrounds the individual resonators. This effective dielectric function is changed by changing the dielectric function of the ferroelectric element 50. For this purpose a voltage is supplied to the ferroelectric element 50 through the conductors 52 and 53 and the electrodes 51 and 54. The integral influencing method shown in FIG. 1 can simultaneously displace the own frequency of all resonators and thereby displace the transmission characteristic of the filter substantially on the frequency axis. Therefore, from the passive components which is a filter element, an active component formed as an electrically tunable filter is realized. An antiferroelectric layer can be also utilized for tuning as the ferroelectric layer used in this embodiment.

Figure 2:
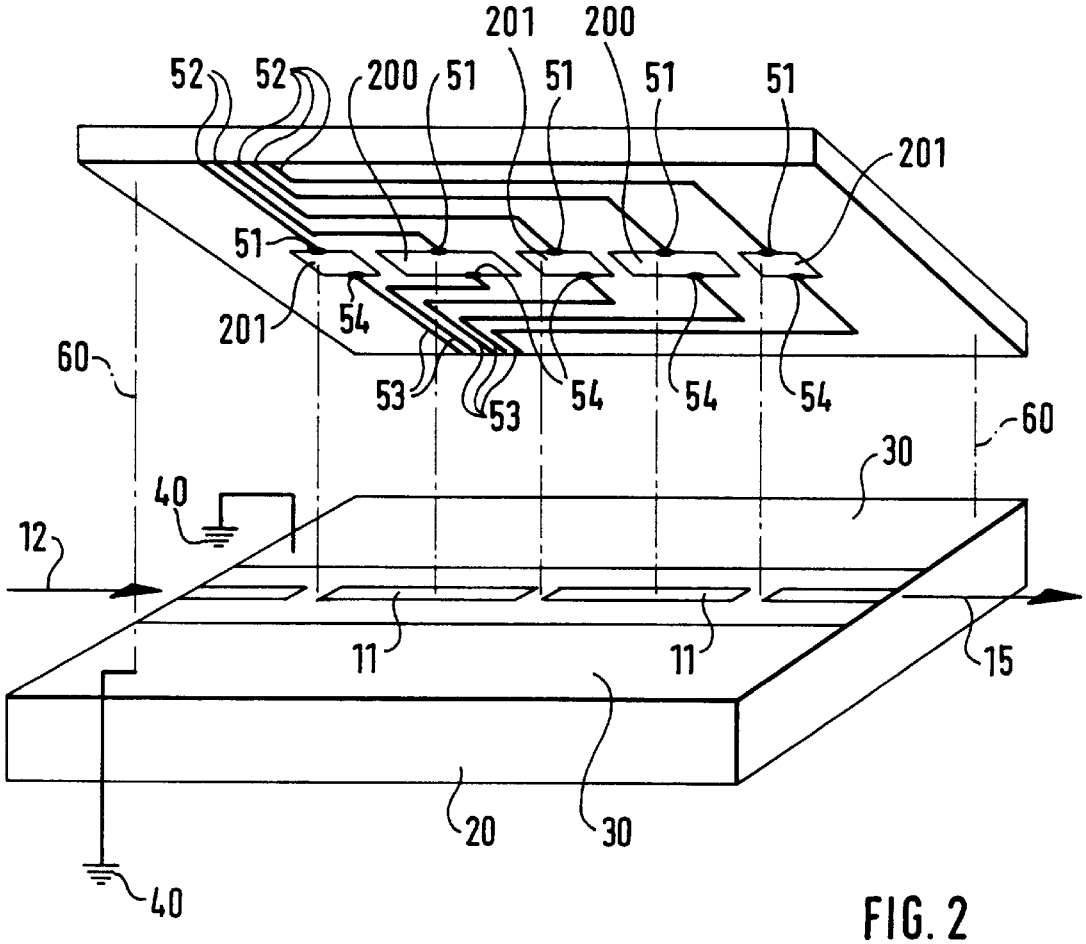
FIG. 2 is a view showing a filter in coplanar construction with a microstructured tuning element located above and composed of several ferroelectric or antiferroelectric tuning elements.

A further preferable embodiment is shown in FIG. 2. Here a filter element is selected as a component. For better visibility, an exploded drawing is made. Broken lines show the points which in assembled position coincide with one another. Functionally identical components are identified here with the same reference numerals as in FIG. 1 and may not be described in detail herein.

The filter element for this example is formed with a coplanar technology. The unstructured layer 30 without waveguiding structure which operates as a ground conductor 40 is located in the same plane as the filter structure with its resonators 11. The functional difference from the embodiment shown in FIG. 1 is the ferroelectric or antiferroelectric tuning unit. The ferroelectric or anti ferroelectric layer is microstructured. A ferroelectric or antiferroelectric microstructure 200 is located over each resonator. It is available via substantially small lateral sizes as the associated resonator. Also, a ferroelectric or antiferroelectric structure 201 is located over each intermediate space between two resonators. Its size is selected so that it overlaps insignificantly with the superconductive resonators. All ferroelectric or antiferroelectric elements can be produced from the same layer by microstructuring methods. However, they can also be composed of different materials, in particular combined ferroelectric-antiferroelectric material.

Each of these compensating elements is available through a respective electrode pair 51 and 54, through which a voltage can be applied. By different voltages applied at the corresponding compensating element or by special material selection and corresponding dielectric constants because of the same applied voltage, the effective dielectric constants can be changed not integrally but also locally. Thereby each own frequency of each resonator as well as each coupling between neighboring resonators can be adjusted separately. By compressing or spreading of the own frequency set of the resonators the filter characteristic can be adjusted to be a substantially small band or a substantially broad band characteristic. By changing the coupling, the three reflectance additional maxima in a transmission band can be reinforced or weakened.

A deviation of this embodiment is provided by the combination of the features of both previous examples, in which a part of the resonators is tuned individually while another part of the resonators is tuned integrally.

Figure 3:
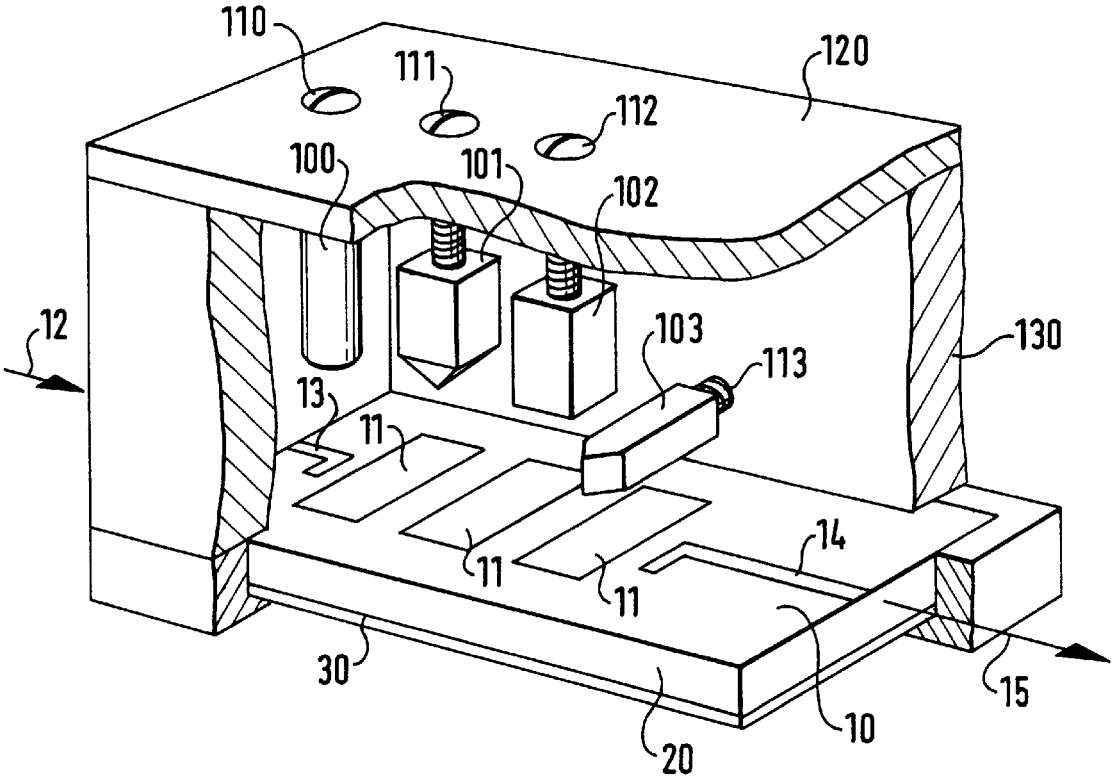
FIG. 3 is a view showing a planar filter with a microstrip conductor structure with massive ferroelectric or antiferroelectric interference bodies for tuning which are movably suspended on a housing wall by screws.

A further embodiment is shown in FIG. 3. Those parts of this embodiment which are similar tot he parts of preceding embodiments are identified with the same reference numerals and are not all described in detail. The filter element of FIG. 1 in microstrip conductor structure, here composed of only three resonators, is located in a housing which is partially sectioned for reasons of better understanding and has an upper wall 12. Massive ferroelectric or antiferroelectric bodies 100, 101, 102 are located above the filter element 10 and mounted by screws 110, 111, 112 on the housing cover to be adjustable as to their height. Also, the lateral adjustment is also possible as selected for the ferroelectric or antiferroelectric body 103, which is connected by a screw 113 with the side wall 130 of the filter housing. The adjustment of the filter characteristic is performed with the same principle as in the embodiment shown in FIG. 2. However, a contribution of the ferroelectric or antiferroelectric element to the effective dielectric constant because of the greater volume portion is higher, and results in a broader adjustment region. Also, a further adjusting parameter is available with the distance between the wave-guide and ferroelectric and antiferroelectric element. Thereby a greater preadjustment can be performed by placing the individual adjusting elements. The fine compensation as well as a post guidance of the filter characteristic which is required in the course of the drift phenomena, can be performed in electrical way through the ferroelectric or antiferroelectric elements.

A deviation of this embodiment resides in that the antiferroelectric or ferroelectric interference body is mounted with piezo-translators instead of screws. Thereby an exclusively electrical adjustment of the filter is performed.

A further deviation of this embodiment resides in that the antiferroelectric or ferroelecltric interference body is mounted rigidly on the housing inner surface without additional mechanical position adjustment. If the flexibility of the electrical adjustment suffices by changing the dielectric constant, a mechanically simple mounting is obtained.

A further deviation of the above mentioned embodiments is based on the recognition that the dielectric constant of the ferroelectric or the antiferroelectric in the vicinity of the phase transition has a strong temperature dependence. Thereby the electrical control of the effective dialectricity constant of the environment of the filter element can be realized, also indirectly by a device for adjusting the temperature of the tuning element.

It will be understood that each of the elements described above, or two or more together, may also find a useful application in other types of constructions differing from the types described above.

While the invention has been illustrated and described as embodied in planar filter with ferroelectric and/or antiferroelectric elements, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electrically tunable planar filter, comprising a filter element including a substrate having an upper side and a waveguide structure arranged on said upper side of said substrate; at least one tuning element operative for tuning said waveguide structure and composed of a material selected from the group consisting of a ferroelectric and an antiferroelectric material with a respective adjustable voltage applied to said at least one tuning element and thereby providing an adjustable dielectric constant, said at least one tuning element being arranged at said upper side of said substrate, said waveguide structure and said at least one tuning element being separate non-integral components.

2. An electrically tunable planar filter as defined in claim 1, wherein said waveguide structure and said at least one tuning element are arranged so that a relative position between said waveguide structure and said at least one tuning element is adjustable.

3. An electrically tunable planar filter as defined in claim 1, wherein said at least one tuning element is mounted above said upper side of said substrate.

4. An electrically tunable planar filter as defined in claim 1, wherein said at least one tuning element is at least one massive body.

5. An electrically tunable planar filter as defined in claim 1, wherein said waveguide structure is composed of a high temperature super-conductor.

6. An electrically tunable planar filter as defined in claim 1; and further comprising means for changing a temperature of said at least one tuning element.

7. An electrically tunable planar filter as defined in claim 1; and further comprising a housing cover, said filter element being arranged in a housing.

8. An electrically tunable planar filter, comprising a filter element including a substrate having an upper side and a waveguide structure arranged thereon; at least one tuning element composed of a material selected from a group consisting of a ferroelectric material and an antiferroelectric material with a respective adjustable voltage applied to said at least one tuning element and thereby providing an adjustable dielectric constant, said at least one tuning element being arranged at said upper side of said substrate, said at least one tuning element being a layer; and an insulating space through which said layer is mounted to said substrate.

9. An electrically tunable planar filter, comprising a filter element including a substrate having an upper side and a waveguide structure arranged thereon; at least one tuning element composed of a material selected from the group consisting of a ferroelectric material and an antiferroelectric material with a respective adjustable voltage applied to said at least one tuning element and thereby providing an adjustable dielectric constant, said at least one tuning element being arranged at said upper side of said substrate, said at least one tuning element being a microstructured layer which is arranged on said substrate; and an insulating space through which said layer is mounted to said substrate.

* * * * *